US010910754B2

(12) United States Patent
Tsukiyoshi et al.

(10) Patent No.: US 10,910,754 B2
(45) Date of Patent: Feb. 2, 2021

(54) STACKED CONNECTOR

(71) Applicant: Sumitomo Wiring Systems, Ltd., Mie (JP)

(72) Inventors: Keiichi Tsukiyoshi, Mie (JP); Yuto Harada, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/660,867

(22) Filed: Oct. 23, 2019

(65) Prior Publication Data

US 2020/0136295 A1 Apr. 30, 2020

(30) Foreign Application Priority Data

Oct. 24, 2018 (JP) ..... 2018-199639

(51) Int. Cl.

| | |
|---|---|
| ***H01R 13/422*** | (2006.01) |
| ***H01R 13/639*** | (2006.01) |
| ***H01R 13/436*** | (2006.01) |
| ***H01R 13/502*** | (2006.01) |
| ***H01R 13/514*** | (2006.01) |

(52) U.S. Cl.

CPC ..... *H01R 13/4223* (2013.01); *H01R 13/436* (2013.01); *H01R 13/502* (2013.01); *H01R 13/514* (2013.01); *H01R 13/639* (2013.01)

(58) Field of Classification Search

CPC ..... H01R 13/4223; H01R 13/4362; H01R 13/436; H01R 13/502; H01R 13/514; H01R 13/639

USPC ..... 439/752, 595, 701, 733.1

See application file for complete search history.

(56) References Cited

U.S. PATENT DOCUMENTS

| | | | | |
|---|---|---|---|---|
| 6,343,959 | B2 * | 2/2002 | Sato | H01R 13/6273 439/701 |
| 7,297,032 | B2 * | 11/2007 | Kobayashi | H01R 13/4361 439/595 |
| 7,695,315 | B2 * | 4/2010 | Hitchcock | H01R 13/4223 439/541.5 |
| 9,673,560 | B2 * | 6/2017 | Iihoshi | H01R 13/514 |
| 9,722,341 | B2 * | 8/2017 | Chikusa | H01R 13/4223 |
| 10,498,068 | B2 * | 12/2019 | Takagi | H01R 13/502 |
| 2008/0119084 | A1 * | 5/2008 | Hitchcock | H01R 13/506 439/541.5 |
| 2016/0365663 | A1 | 12/2016 | Chikusa et al. | |

FOREIGN PATENT DOCUMENTS

| | | |
|---|---|---|
| JP | 2017-4736 | 1/2017 |

* cited by examiner

*Primary Examiner* — Hien D Vu

(74) *Attorney, Agent, or Firm* — Gerald E. Hespos; Michael J. Porco; Matthew T. Hespos

(57) ABSTRACT

A stacked connector includes a first housing (10A) and a second housing (10B) to be stacked one on the other. The first and second housings (10A, 10B) include deflectable first locking lances (24A) and second locking lances (24B) configured to lock first terminal fittings (60A) and second terminal fittings (60B). The first and second locking lances (24A, 24B) include first base ends (22A) and second bases (22B) exposed in a first facing surface (11A) and a second facing surface (11B). The first and second base ends (22A, 22B) include parts overlapping in a stacking direction of the first and second housings (10A, 10B).

2 Claims, 8 Drawing Sheets

STACKED CONNECTOR

BACKGROUND

Field of the Invention

The invention relates to a stacked connector.

Related Art

Japanese Unexamined Patent Publication No. 2017-4736 discloses a connector with includes first and second housings to be assembled with each other in a stacked state. Each housing includes cavities and terminal fittings are inserted respectively into the cavities.

Deflectable locking lances are provided for locking the terminal fittings in the cavities and are exposed in facing surfaces of the housings that face each other when the housings are assembled. Each locking lance is cantilevered forward from a base end part located in a central part of the facing surface in a front-rear direction. A locking surface is on a tip of each locking lance facing the cavity and is capable of contacting the terminal fitting.

An excessive rearward pull-out force on the terminal fitting can cause the locking lance to buckle at the base end, thereby reducing an engagement margin of the locking surface with the terminal fitting and reducing a holding force of the locking lance. The buckling of the base end part of the locking lance can be padded for reinforcement. However, the base end parts of the locking lances are exposed in the facing surfaces in the above-described stacked connector, and merely padding of the base end parts in such a positional relationship could interfere with the housings as stacking partners. Thus, it is difficult to provide a reinforcing structure because a height of the stacked connector would need to be increased by a padded amount.

The invention was completed on the basis of the above situation and aims to provide a stacked connector capable of improving holding forces of locking lances.

SUMMARY

The invention is directed to a stacked connector with two housings to be stacked one on the other. Each housing includes a cavity, and terminal fittings are insertable into the respective cavities. Deflectable locking lances project respectively into the cavities and are configured to lock the terminal fittings. Base ends of the locking lances serve as deflection fulcrums and are exposed in surfaces of the housings facing one another in a stacking direction of the housings. The base ends of the locking lances include parts overlapping in the stacking direction when the housings are stacked. Thus, the base ends of the locking lances are reinforced by the overlapping parts, and holding forces of the locking lances can be improved without enlarging the stacked connector in the stacking direction.

The locking lances of the respective housings may be arranged back-to-back. Each locking lance may be cantilevered from the base end toward a tip. A protrusion may be formed on a first widthwise side of the base end and may project toward the housing that is a stacking partner to form the overlapping part. A locking portion may be formed on a second widthwise side of the tip and may be configured to lock the terminal fitting. A pull-out force may act on the terminal fitting. However, the protrusion located diagonally to the locking portion can firmly receive stress applied to the locking lance. Thus, the locking lance will not deform to bend in a pull-out direction and outwardly of the other widthwise side so that the base end part will not buckle.

DETAILED DESCRIPTION

An embodiment is described with reference to FIGS. 1 to 8. A stacked connector of this embodiment includes a first housing 10A and a second housing 10B to be stacked one on the other. First terminal fittings 60A and second terminal fittings 60B are accommodated respectively in the first and second housings 10A, 10B. Note that, in the following description, a left side of FIG. 2 is referred to as a front concerning a front-rear direction and a vertical direction is based on a vertical direction of FIGS. 1 to 5.

Figure 5:
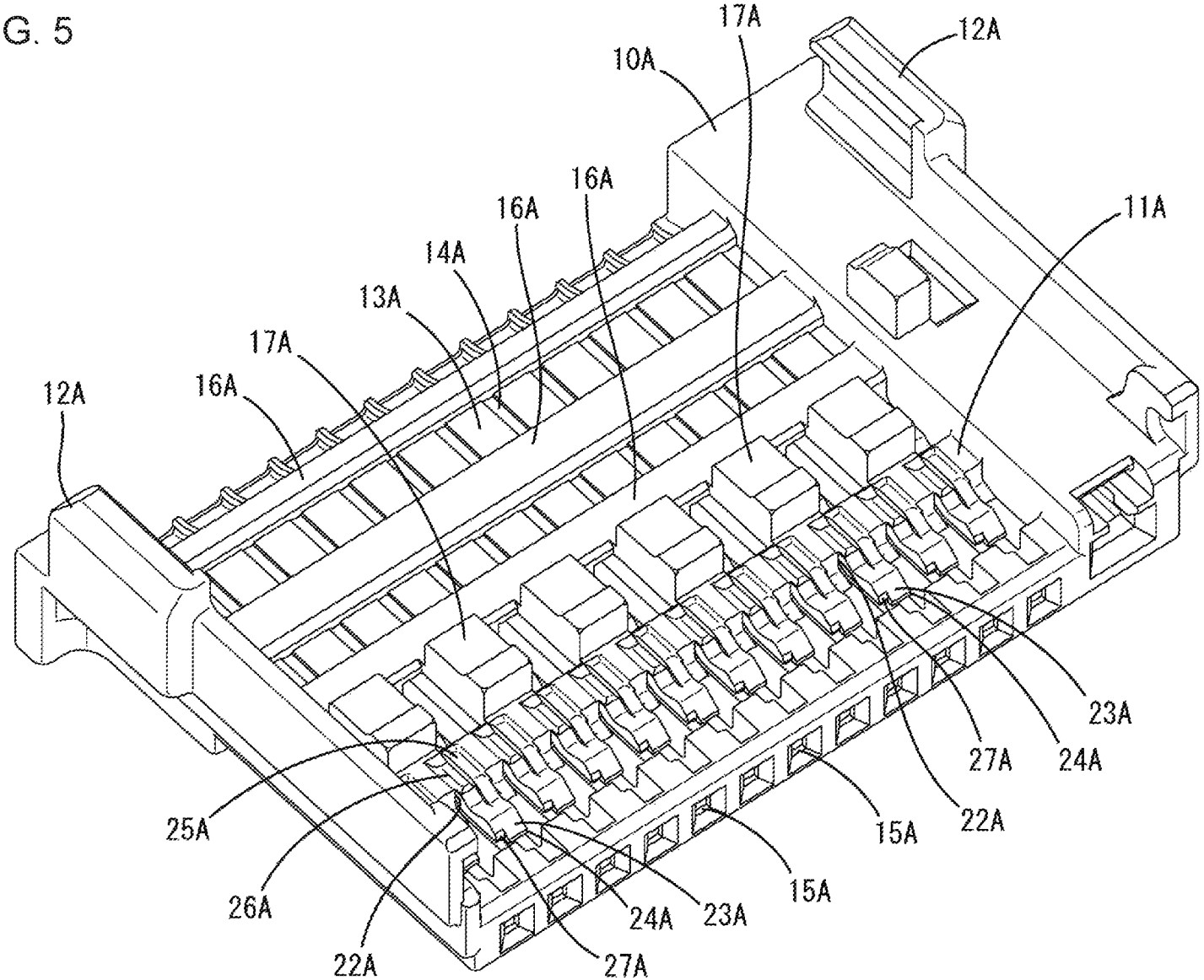
FIG. 5 is a perspective view of a first housing viewed from above.

The first housing 10A is a lower housing and, as shown in FIG. 5, has a flat shape with a first facing surface 11A facing the second housing 10B as a stacking partner on an upper surface. The first housing 10A includes first housing locks 12A in the form of plates extending along the front-rear direction on both widthwise end parts.

Figure 2:
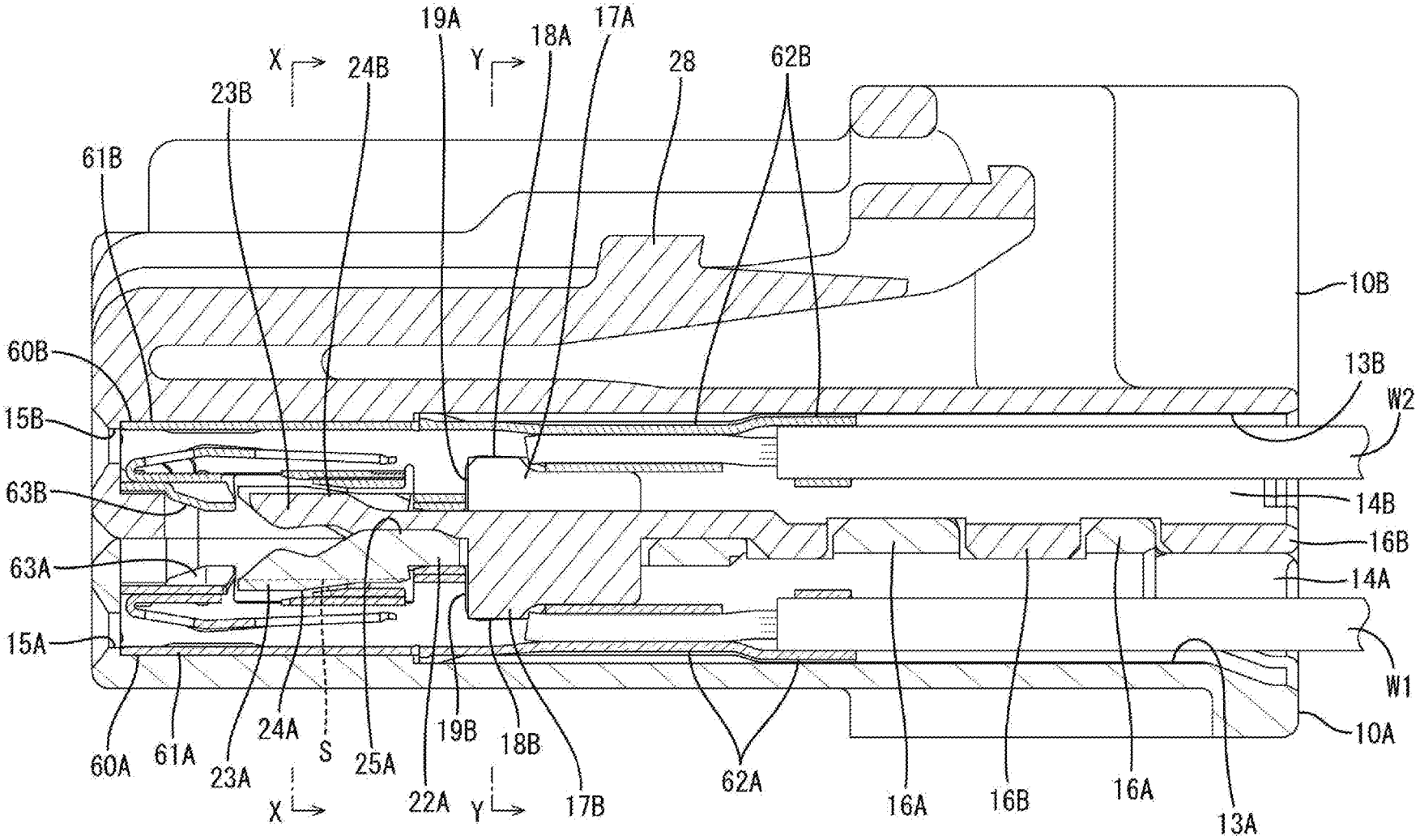
FIG. 2 is a side view in section of the stacked connector.
Figure 3:
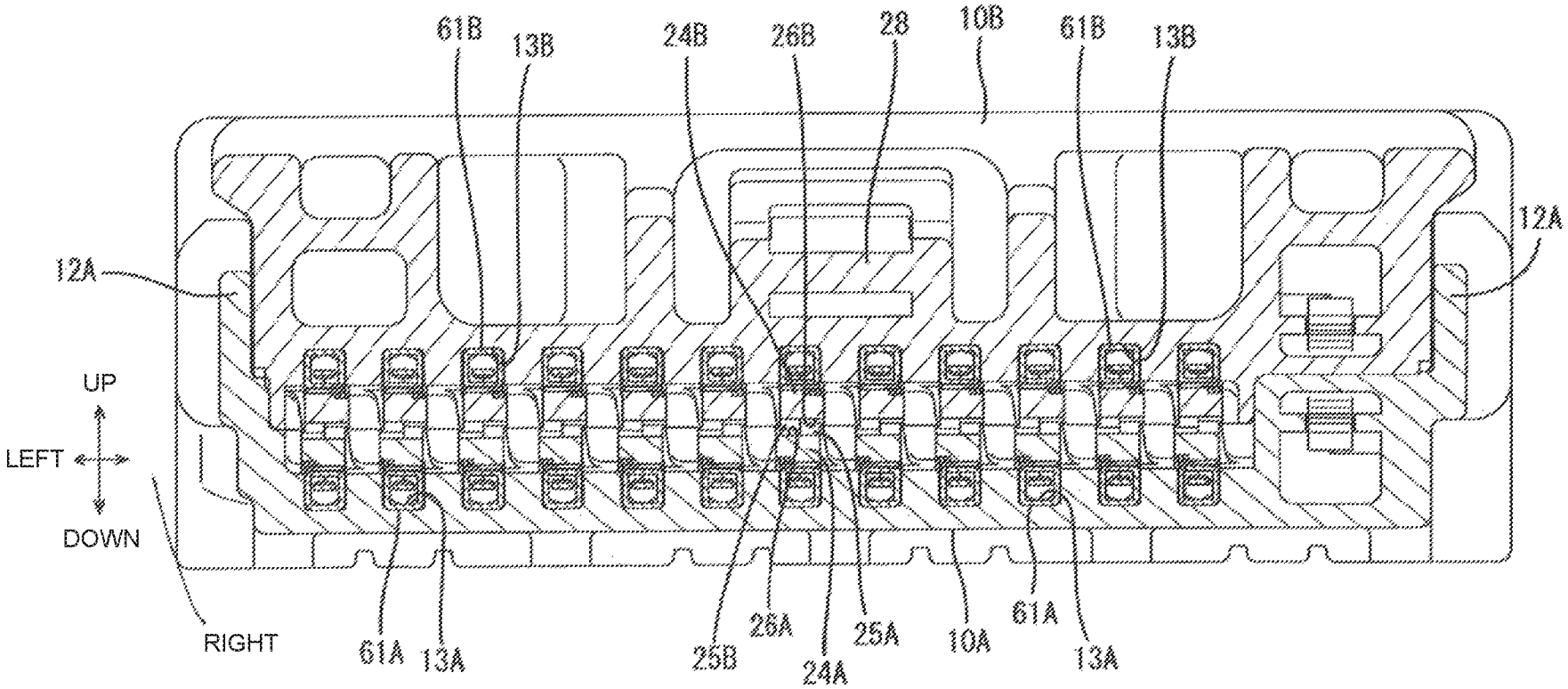
FIG. 3 is a section along X-X of FIG. 2.

As shown in FIG. 2, the first housing 10A includes first cavities 13A and the first terminal fittings 60A are insertable therein. The first cavities 13A are arranged in a row in a width direction while being partitioned by first partition walls 14A.

First insertion openings 15A are formed in a front wall of the first housing 10A and communicate respectively with the first cavities 13A. Tabs of unillustrated mating first terminals mounted in a mating connector are inserted into the corresponding first cavities 13A through the respective first insertion openings 15A.

As shown in FIG. 5, the first housing 10A includes first bridges 16A extending across the respective first cavities 13A in the width direction and coupled to the upper ends of the respective first partition walls 14A on the first facing surface 11A. The first bridges 16A are strips provided at intervals in the front-rear direction.

First detecting portions 17A project from the first facing surface 11A of the first housing 10A and are connected to a front part of the first bridge 16A that is arranged in a substantially central part in the front-rear direction. The first detecting portions 17A are coupled to the upper end of every other one of the first partition walls 14A arranged in the width direction. As shown in FIG. 2, each first detecting portion 17A is a rectangular block that has a first detecting surface 18A extending along the front-rear direction on an upper surface and a first retaining surface 19A extending along the vertical direction on a front surface. As described later, the first detecting portion 17A functions to detect an incompletely inserted state of the second terminal fittings 60B in the second housing 10 as the stacking partner and to retain the properly inserted second terminal fittings 60B.

Figure 4:
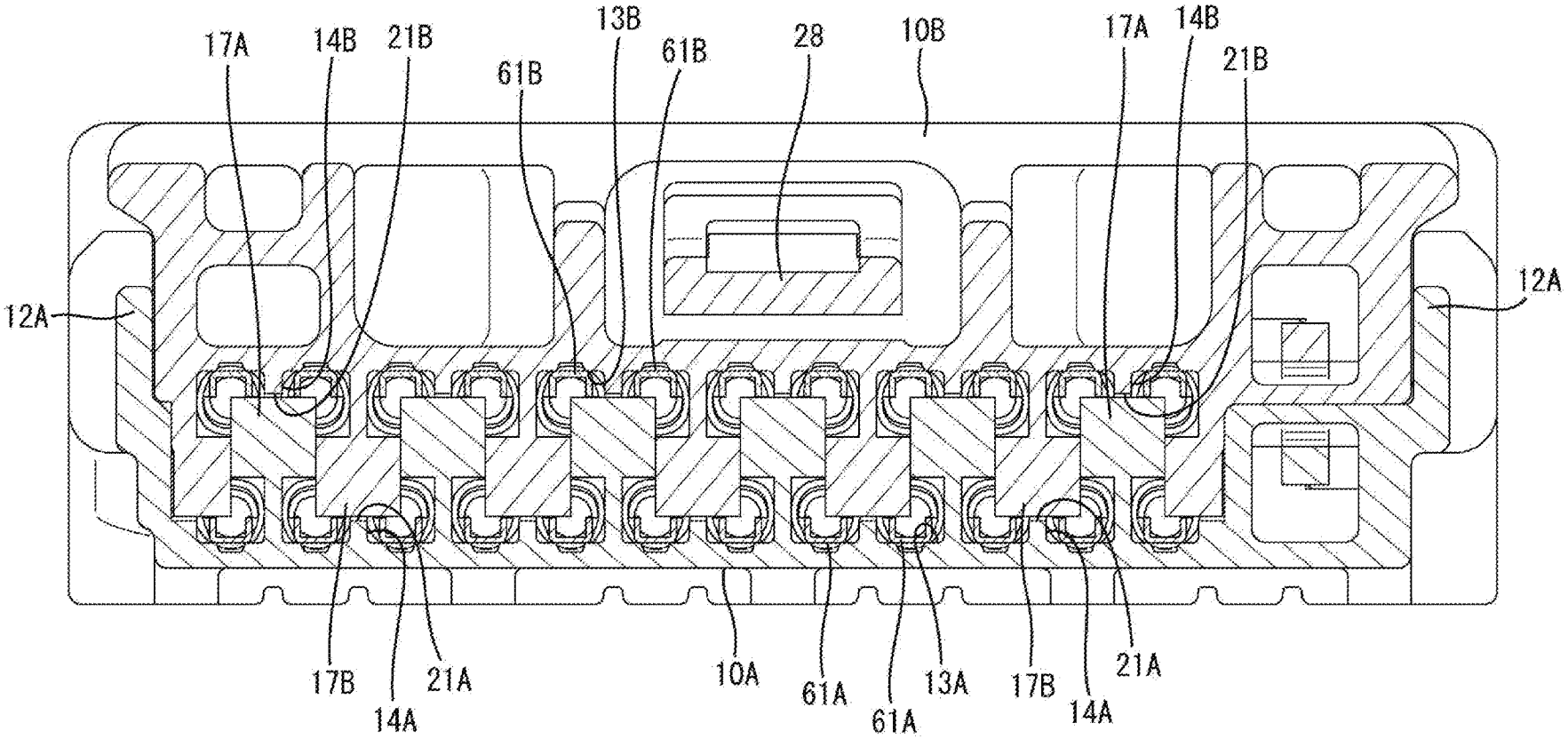
FIG. 4 is a section along Y-Y of FIG. 2.

As shown in FIG. 4, every other one of the first partition walls 14A has no first detecting portion 17A coupled thereto and includes a first recess 21A slightly dropped from front and rear adjacent parts on an upper end between the adjacent first detecting portions 17A. A second detecting portion 17B to be described later can enter the first recess 21A.

As shown in FIG. 5, the first housing 10A includes first base ends 22A integrally connected to the front ends of the respective first detecting portions 17A at positions corresponding to the respective first cavities 13A, and first locking lances 24A are cantilevered from the first base ends 22A to first tips 23A. The entirety of each first locking lance 24A including the first base end 22A is exposed in the first facing surface 11A. Both widthwise ends of each first locking lance 24A are coupled integrally to the corresponding first partition walls 14A or an end wall of the first housing 10A.

Figure 6:
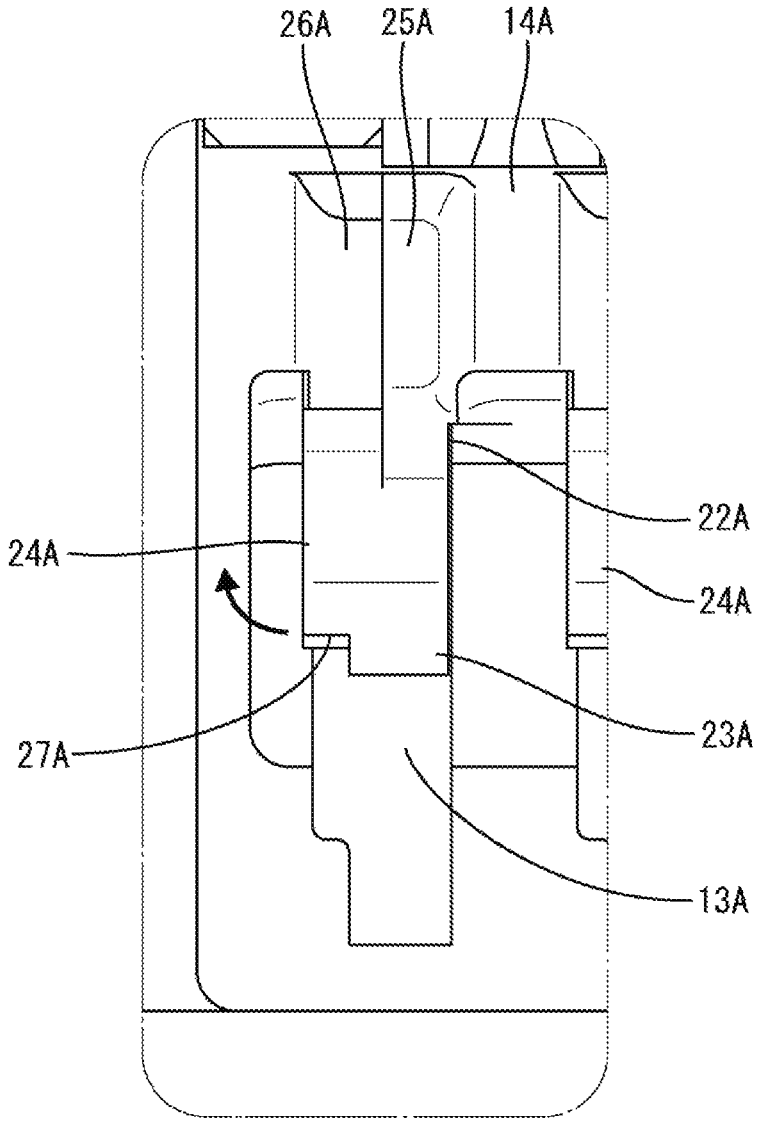
FIG. 6 is an enlarged plan view of a first locking lance and a peripheral structure thereof.

As shown in FIGS. 5 and 6, the first locking lance 24A includes a first protrusion 25A projecting up on one widthwise side (right side of FIG. 6) of the first base end 22A. The first protrusion 25A is a rib extending in the front-rear direction and has a substantially rectangular cross-section. The upper surface of the first protrusion 25A is arranged substantially along the front-rear direction. The first locking lance 24A includes a first recess 26A slightly dropped from the upper end surface of the first protrusion 25A on the other widthwise side of the first base end 22A.

As shown in FIG. 2, a part of the upper surface of the first locking lance 24A between the first base end 22A and the first tip 23A is inclined down toward the front. The lower surface of the first locking lance 24A extends substantially straight forward after being slightly dropped from a rear end part so as to enter the corresponding first cavity 13A.

The first tip 23A of the first locking lance 24A is formed to enter the first cavity 13A, the lower surface thereof is arranged substantially along the front-rear direction and the upper surface thereof projects with a substantially chevron shape. The first tip 23A of the first locking lance 24A has a first locking portion 27A cut into a rectangular recess on one corner of the other widthwise side. The first locking portion 27A is lockable to a later-described first locking protrusion 63A of the first terminal fitting 60A. Note that a shear force received from the later-described first locking protrusion 63A of the first terminal fitting 60A by the first locking lance 24A is received by a region S in the front-rear direction from the first tip 23A to the first base end 22A behind the first locking protrusion 63A.

Figure 8:
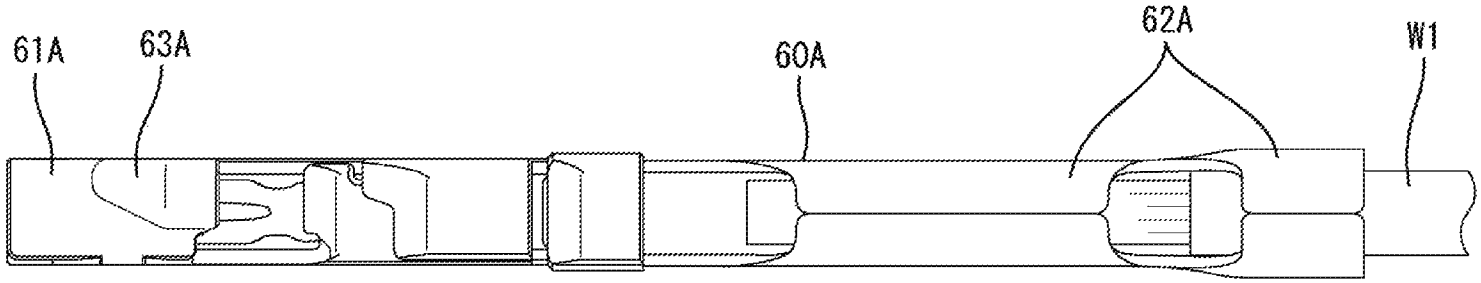
FIG. 8 is a plan view of a first terminal fitting.

The first terminal fitting 60A is formed such as by bending a conductive metal plate and includes, as shown in FIGS. 2 and 8, a rectangular tubular first body 61A in a front part and a first barrel 62A provided behind the first body 61A. The first barrel 62A is to be connected electrically and mechanically to an end part of a wire W1. A locking protrusion 63A bulges up on an upper surface of the first body 61A on the other widthwise side (side where the first locking portion 27A is located.

Figure 7:
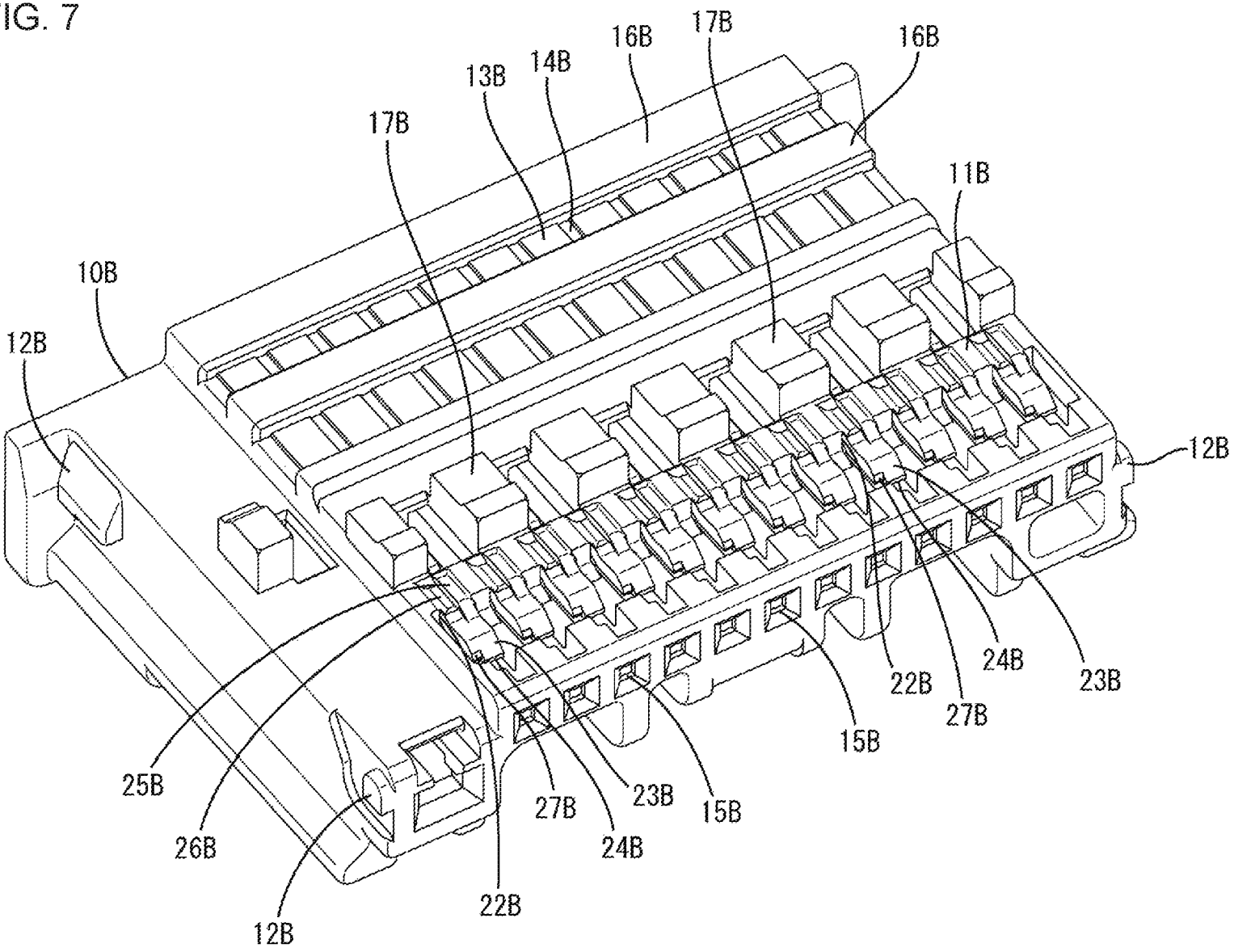
FIG. 7 is a perspective view of a second housing viewed from below.

The second housing 10B is an upper housing located on an upper side and, as shown in FIG. 7, has a flat shape. The lower surface of the second housing 10B serves as a second facing surface 11B facing the second housing 10B as a stacking partner.

Figure 1:
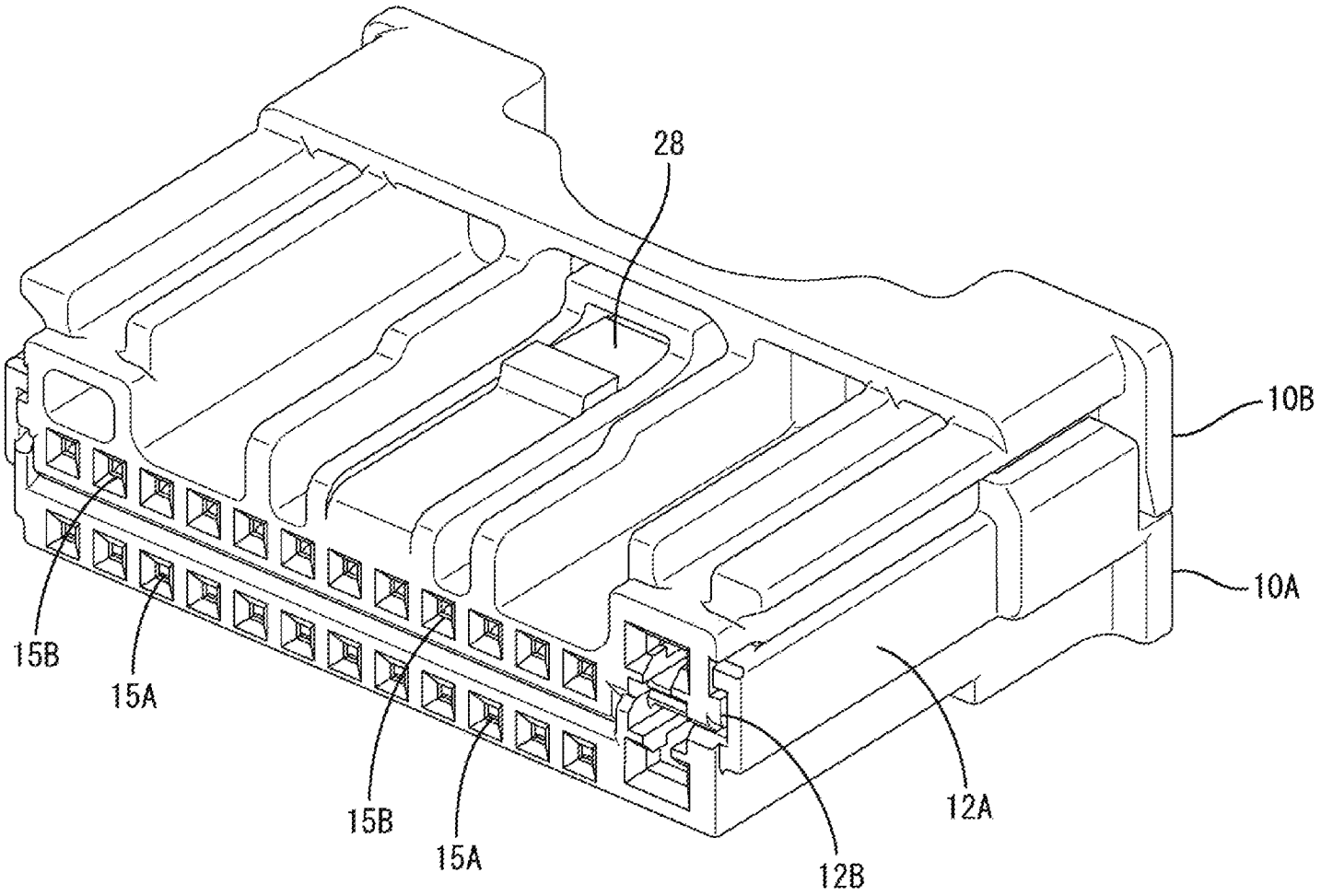
FIG. 1 is a perspective view of a stacked connector in one embodiment of the invention.

As shown in FIG. 1, the second housing 10B includes a deflectable lock arm 28 cantilevered in a widthwise central part of the upper surface. The second housing 10B also includes second housing locks 12B spaced apart in the front-rear direction on both widthwise end parts. The second housing locks 12B are locked resiliently to the corresponding first housing locks 12A to hold the first and second housings 10A and 10B united. Further, the first and second united housings 10A and 10B can be connected to the mating connector so that the lock arm 28 resiliently locks the mating connector to hold the first housing 10A and the second housing 10B together.

The second housing 10B includes second cavities 13B similar to the first cavities 13A, second partition walls 14B similar to the first partition walls 14A, second insertion openings 15B similar to the first insertion openings 15A, second bridges 16B similar to the first bridges 16A, second detecting portions 17B similar to the first detecting portions 17A, second recesses 21B similar to the first recesses 21A and second locking lances 24B similar to the first locking lances 24A.

As shown in FIG. 2, the second detecting portion 17B has a second retaining surface 19B similar to the first retaining surface 19A and a second detecting surface 18B similar to the first detecting surface 18A. As shown in FIG. 7, the second locking lance 24B includes a second base end 22B similar to the first base end 22A, a second tip 23B similar to the first tip 23A, a second protrusion 25B similar to the first protrusion 25A, a second recess 26B similar to the first recess 26A and a second locking portion 27B similar to the first locking portion 27A. However, these parts of the second housing 10B are oriented to be vertically opposite to corresponding parts of the first housing 10A. When the first housing 10A and the second housing 10B are in the united state, the second bridges 16B are fit in front of or behind the first bridges 16A (see FIG. 2), the second detecting portions 17B are in the first recesses 21A and the first detecting portions 17A are in the second recesses 21B (see FIG. 4). In this way, the first and second bridges 16A, 16B are meshed in the front-rear direction and the first and second detecting portions 17A, 17B are meshed in the width direction, thereby restricting positional deviations of the united first and second housings 10A, 10B along the first and second facing surfaces 11A, 11B.

Further, when the first and second housings 10A, 10B are united, the second locking lances 24B are arranged back-to-back with the respective first locking lances 24A, the second protrusions 25B of the second locking lances 24B are fit in the first recesses 26A of the respective first locking lances 24A, and the second recesses 26B of the second locking lances 24B are fit to the first protrusions 25A of the respective first locking lances 24A. In this way, tips of the second protrusions 25B of the second locking lances 24B and tips of the first protrusions 25A of the first locking lances 24A are arranged to mesh alternately with each other when viewed in the width direction (lateral direction of FIG. 3) extending along the first and second facing surfaces 11A, 11B (see FIG. 3). In other words, when the first and second housings 10A, 10B are united, the tips of the second protrusions 25B of the second locking lances 24B and the tips of the first protrusions 25A of the first locking lances 24A overlap each other in the vertical direction (stacking direction; vertical direction of FIG. 3).

The second terminal fitting 60B has the same shape as the first terminal fitting 60A and, as shown in FIG. 2, is connected to an end part of a wire W2, inserted in a posture vertically inverted from that of the first terminal fitting 60A into the second cavity 13B and locked by the second locking lance 24B. The second terminal fitting 60B includes a second body 61B similar to the first body 61A, a second barrel 62B similar to the first barrel 62A and a second locking protrusion 63B similar to the first locking protrusion 63A.

Next, an assembling method and functions of the stacked connector of this embodiment are described.

In assembling, the first terminal fittings 60A are inserted into the first cavities 13A of the first housing 10A from behind. In the process of inserting the first terminal fitting 60A into the first cavity 13A, the first locking protrusion 63A interferes with the first locking lance 24A and the first locking lance 24A is deflected upward with the first base end 22A as a fulcrum. When the first terminal fitting 60A is inserted properly into the first cavity 13A, the first locking lance 24A resiliently returns and the first locking portion 27A of the first tip 23A is arranged to contact the rear end of the first locking protrusion 63A. In this way, the first terminal fitting 60A is locked primarily to be retained in the first cavity 13A. Similarly, the second terminal fittings 60B are inserted into the second cavities 13B of the second housing 10B and locked primarily to be retained by the second locking portions 24B.

Subsequently, the first and second facing surfaces 11A, 11B are caused to face each other in the vertical direction and, in that state, the first and second housings 10A, 10B are brought closer to and united with each other. If the first terminal fitting 60A is not inserted completely into the first cavity 13A, the second detecting surface 18B of the second detecting portion 17B contacts the upper surface of the first body 61A to form a clearance between the first and second facing surfaces 11A, 11B, thereby restricting the entrance of the second detecting portion 17B into the first recess 21A. Similarly, if the second terminal fitting 60B is not inserted completely into the second cavity 13B, the first detecting surface 18A of the first detecting portion 17A contacts the lower surface of the second body 61B to form a clearance between the first and second facing surfaces 11A, 11B, thereby restricting the entrance of the first detecting portion 17A into the second recess 21B. In this way, it can be detected that the first or second terminal fitting 60A, 60B is in an incompletely inserted state.

When the first and second housings 10A, 10B are united properly, each first detecting portion 17A is in the corresponding second recess 21B and located to correspond to two second terminal fittings 60B inserted into the second cavities 13B adjacent across that second recess 21B, and the first retaining surface 19A of each first detecting portion 17A is arranged to contact and lock the second bodies 61B of the two second terminal fittings 60B from behind (see FIGS. 2 and 4). Similarly, when the first and second housings 10A, 10B are united properly, each second detecting portion 17B is in the corresponding first recess 21A and located to correspond to two first terminal fittings 60A inserted into the first cavities 13A adjacent across that first recess 21A, and the second retaining surface 19B of each second detecting portion 17B is arranged to contact and lock the first bodies 61A of the two first terminal fittings 60A from behind. In this way, the first and second terminal fittings 60A, 60B are held reliably in the first and second cavities 13A, 13B.

For example, if the wire W1 connected to the first terminal fitting 60A is pulled rearward before the first and second housings 10A, 10B are united, stress may be generated in a locking region of the first locking protrusion 63A and the first locking portion 27A, the first base end part 22A may be buckled and the engagement margin of the first locking protrusion 63A and the first locking portion 27A may be reduced. However, in the case of this embodiment, the first locking lance 24A can receive a shear force of the first locking protrusion 63A in the wide region S from the first base end part 22A to the first tip part 23A and the first base end part 22A is reinforced by including the first protrusion 25A. Thus, the first base end part 22A is hardly buckled and a predetermined engagement margin of the first locking protrusion 63A and the first locking portion 27A can be maintained. Similarly, even if a rearward pull-out force acts on the second terminal fitting 60B, the second base end part 22B is hardly buckled because of the region from the second base end part 22B to the second tip part 23B and the second protrusion 25B. Thus, a predetermined engagement margin of the second locking protrusion 63B and the second locking portion 27B can be maintained.

The first and second protrusions 25A and 25B include parts overlapping in the vertical stacking direction when the first and second housings 10A, 10B are united. Thus, the first and second protrusions 25A and 25B do not enlarge the stacked connector in the vertical direction.

Further, even if the first and second locking lances 24A and 24B are arranged back-to-back when the first and second housings 10A, 10B are united, the first protrusions 25A of the first base ends 22A are fit in the second recesses 26B, and the second protrusions 25B of the second base ends 22B are fit in the first recesses 26A. Thus, a reinforcing structure for the first and second locking lances 24A, 24B is realized without any problem.

Furthermore, the first and second protrusions 25A, 25B are arranged on one widthwise sides (one widthwise side in the case of the first protrusion 25A) of the first and second base ends 22A, 22B and the first and second locking portions 27A, 27B are arranged on other widthwise sides (other widthwise side in the case of the first locking portion 27A) of the first and second tips 23A, 23B. Thus, the first and second protrusions 25A, 25B located diagonally to the first and second locking portions 27A, 27B can firmly receive stress due to the pulling of the wires W1, W2, and the first and second locking lances 24A, 24B are not deformed to be bent rearward in a pulling direction of the wires W1, W2 and outwardly of the other widthwise side (see an arrow of FIG. 6) and the first and second base end parts 22A, 22B are not buckled.

Other embodiments are described briefly below.

The stacked connector may be configured by stacking three or more housings including a pair of housings (first housing and second housing).

The first and second locking lances may be arranged in an offset manner in the width direction (direction along the facing surfaces) without being arranged back-to-back when the first and second housings are united.

The vertically overlapping parts of the first and second base end parts may be provided over the entire widths of the first and second locking lances.

The first and second protrusions may be arranged in an overlapping manner over the entire heights in the vertical direction (stacking direction) when the first and second housings are united.

LIST OF REFERENCE SIGNS

10A . . . first housing
10B . . . second housing
11A . . . first facing surface
11B . . . second facing surface
13A . . . first cavity
13B . . . second cavity
22A . . . first base end
22B . . . second base end
23A . . . first tip
23B . . . second tip
24A . . . first locking lance

24B . . . second locking lance
25B . . . first protrusion
25B . . . second protrusion

What is claimed is:

1. A stacked electrical connector, comprising first and second housings to be stacked one on the other, wherein:

the first housing is formed with a first cavity and the second housing is formed with a second cavity, each of the first and second cavities having a base wall and having opposite rear and front ends, first and second terminal fittings being insertable respectively into the first and second cavities in a rear to front direction, and first and second deflectable locking lances cantilevered forward from the base walls of the respective first and second cavities and configured respectively to lock the first and second terminal fittings by projecting respectively into the first and second cavities, rear parts of the first and second locking lances defining base ends serving as deflection fulcrums, the first and second locking lances being exposed in facing surfaces of the first and second housings facing in a stacking direction of the first and second housings; and a first widthwise side of the base end of the first locking lance including a first protrusion and a second widthwise side of the base end of the second locking lance including a second protrusion, the first and second protrusions being adjacent to one another in a widthwise direction and overlapping in the stacking direction with the first and second housings stacked.

2. The stacked electrical connector of claim 1, wherein the first and second locking lances of the respective first and second housings are arranged back-to-back, and each locking lance is cantilevered from the respective base end toward a tip and includes a locking portion configured to lock the terminal fitting on the other widthwise side of the tip.

* * * * *